US010281857B1

(12) United States Patent
Aikawa

(10) Patent No.: US 10,281,857 B1
(45) Date of Patent: May 7, 2019

(54) FIXING DEVICE AND IMAGE FORMING APPARATUS

(71) Applicant: KYOCERA Document Solutions Inc., Osaka (JP)

(72) Inventor: Yukihiro Aikawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/151,438

(22) Filed: Oct. 4, 2018

(30) Foreign Application Priority Data

Dec. 14, 2017 (JP) ..... 2017-239471

(51) Int. Cl.
*G03G 15/20* (2006.01)

(52) U.S. Cl.
CPC ..... *G03G 15/2053* (2013.01); *G03G 15/206* (2013.01); *G03G 15/2064* (2013.01)

(58) Field of Classification Search
CPC ..... G03G 15/2053; G03G 15/206; G03G 15/2064
See application file for complete search history.

(56) References Cited

U.S. PATENT DOCUMENTS

2016/0085188 A1* 3/2016 Takagi ..... G03G 15/2042 399/69
2017/0364003 A1* 12/2017 Takagi ..... G03G 15/2057

FOREIGN PATENT DOCUMENTS

| | | | |
|---|---|---|---|
| JP | 2008-107761 | A | 5/2008 |
| JP | 2008-299205 | A | 12/2008 |
| JP | 2012-037613 | A | 2/2012 |
| JP | 2012-123073 | A | 6/2012 |

* cited by examiner

*Primary Examiner* — Sandra Brase
(74) *Attorney, Agent, or Firm* — Studebaker & Brackett PC

(57) ABSTRACT

A fixing device includes a fixing member, a pressing member and a heater. The heater includes a center heating part, end heating parts, a common electrode, a first individual electrode and a second individual electrode. The center heating part is divided into 2n (n≥2) center heating elements at intervals in the width direction. The center heating elements each has electrodes on both end faces in a conveyance direction and are connected between the common electrode and the first individual electrode in series. Each of the end heating parts is divided into n end heating elements at intervals in the width direction. The end heating elements each has electrodes on both end faces in the conveyance direction and are connected between the common electrode and the second individual electrode in series.

8 Claims, 7 Drawing Sheets

Related Art

Related Art

FIXING DEVICE AND IMAGE FORMING APPARATUS

INCORPORATION BY REFERENCE

This application is based on and claims the benefit of priority from Japanese Patent application No. 2017-239471 filed on Dec. 14, 2017, which is incorporated by reference in its entirety.

BACKGROUND

The present disclosure relates to a fixing device to fix a toner image on a sheet and an image forming apparatus including the fixing device.

In the fixing device, between a fixing belt heated by a heater and a pressing member, a pressing area is formed. When a sheet on which a toner image is transferred is passed through the pressing area, the toner image is heated and pressed to be fixed on the sheet. Recently, in consideration of the fact that high heat efficiency can be obtained, a fixing device of a type in which a heater having a board and a heating element arranged on the board is made to come into contact with an inner circumferential face of the fixing belt has been proposed.

Because such a heater requires large current, if contact resistance between a power supplying electrode and a power supplying connector is large, heat is generated at a contact portion between the electrode and the connector. Thereby, it is required to make contact pressure between them large and to lower the contact resistance. This makes the contact portion large in size.

Additionally, because large electrical resistance of conduction paths connecting the power supplying electrode to the heating element may cause heat generation, it is difficult to arrange the conduction paths without crossing with the contact portion. If the contact portion between the electrode and the connector is overlapped with the conduction paths, when the connecter is connected to the electrode with strong force, an insulator covering a surface of the conduction paths may be scraped by the connector. Accordingly, it is difficult to reduce a number of the connector without crossing the conduction paths.

Then, in some cases, a heating area is divided for a case where a sheet passed through the pressing area has a wide width and a case where a sheet passed through the pressing area has a narrow width. An example of such a heater will be described with reference to FIG. 6 and FIG. 7. FIGS. 6 and 7 are plan views showing the heater. In an example shown in FIG. 6, the heating area of the heater 100 is divided into a center heating part 101 arranged on a center side in the sheet width direction X and end heating parts 103 arranged on both outer side of the center heating part 101. The center heating part 101 corresponds to the sheet having a narrow width while the center heating part 101 and the end heating parts 103 correspond to the sheet having a wide width. On both end faces in the width direction X of each of the center heating part 101 and the end heating parts 103, electrodes 105 and 107 are provided. The heater 100 includes a common electrode 109, a first individual electrode 111 and a second individual electrode 113. The common electrode 109 is arranged at one outer side of the end heating parts 103 in the width direction X, and the first and second individual electrodes 111 and 113 are arranged at the other outer side of the end heating parts 103 in the width direction X.

The center heating part 101 is connected between the common electrode 109 and the first individual electrode 111.

The end heating parts 103 are connected between the common electrode 109 and the second individual electrode 113 in series. In the example, in order to make a heating value per unit length (length along the width direction X) of each of the center heating part 101 and the end heating parts 103 same, the heating element is changed in its thickness and its length along a conveyance direction Y perpendicular to the width direction X and to adjust a resistance per unit length in the width direction X. This makes it difficult to form the heater.

On the other hand, as shown in FIG. 7, in a case where the electrodes 105 and 107 are provided on both end faces in the conveyance direction Y of each of the center heating part 101 and the end heating parts 103, if the center heating part 101 is divided into two parts in the width direction X, the thickness and the length in the conveyance direction Y of the heating parts becomes uniform. In this case, if the resistance per unit length in the width direction X of the heating parts are made to be uniform, it becomes possible for the divided two center heating parts 101 and the end heating parts 103 to have the same heating value per unit length (the length along the conveyance direction).

However, between the electrodes of the divided two center heating parts 101 (between the electrodes which is not connected to the conduction path, a portion surrounded by a circle in FIG. 7), a voltage applied between the common electrode 109 and the first individual electrode 111 is applied. Thereby, it is required to give a space between the divided two heating parts 101 in order to prevent a short circuit. Then, a temperature distribution in the width direction X is uneven around the space, and a fixing performance may be affected.

SUMMARY

In accordance with an aspect of the present disclosure, a fixing device includes a fixing member, a pressing member and a heater. The fixing member and the pressing member are configured to form a pressing area. The heater is configured to heat a toner on a sheet conveyed to the pressing area. The heater includes a center heating part, end heating parts, a common electrode, a first individual electrode and a second individual electrode. The center heating part is arranged on a center side in a width direction perpendicular to a sheet conveyance direction. The end heating parts are arranged on both outer sides of the center heating part in the width direction. The common electrode is arranged on one outer side of the end heating parts in the width direction. The first individual electrode and the second individual electrode are arranged on the other outer side of the end heating parts in the width direction. The center heating part is divided into 2n ($n \geq 2$) center heating elements at intervals in the width direction. The center heating elements each has electrodes on both end faces in the conveyance direction and are connected between the common electrode and the first individual electrode in series. Each of the end heating parts is divided into n end heating elements at intervals in the width direction. The end heating elements each has electrodes on both end faces in the conveyance direction and are connected between the common electrode and the second individual electrode in series.

In accordance with an aspect of the present disclosure, an image forming apparatus includes an image forming part and the fixing device. The image forming part is configured to form a toner image on a sheet. The fixing device is configured to fix the toner image on the sheet.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to the attached drawings, an image forming apparatus and a fixing device of the present disclosure will be described.

Figure 1:
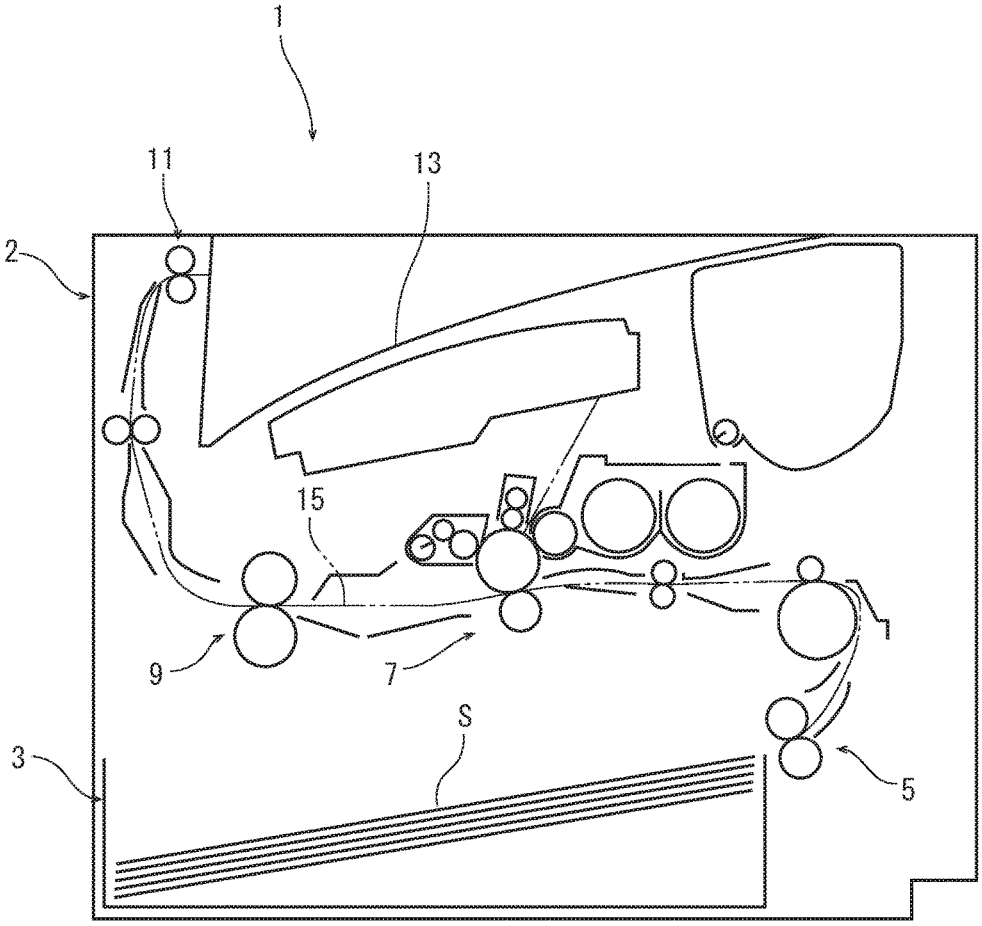
FIG. 1 is a front view schematically showing an inner structure of a printer according to one embodiment of the present disclosure.

First, with reference to FIG. 1, an entire structure of a printer as an image forming apparatus will be described. FIG. 1 is a front view schematically showing an inner structure of the printer.

An apparatus main body 2 of the printer 1 is provided with a sheet feeding cassette 3 storing a sheet S, a sheet feeding device 5 feeding the sheet S from the sheet feeding cassette 3, an image forming part 7 forming a toner image on the sheet S, a fixing device 9 fixing the toner image on the sheet S, an ejecting device 11 ejecting the sheet S and an ejected sheet tray 13 on which the ejected sheet S is stacked. In the apparatus main body 2, a conveyance path 15 for the sheet S is formed so as to extend from the sheet feeding device 5 to the ejecting device 11 through the image forming part 7 and the fixing device 9.

Figure 2:
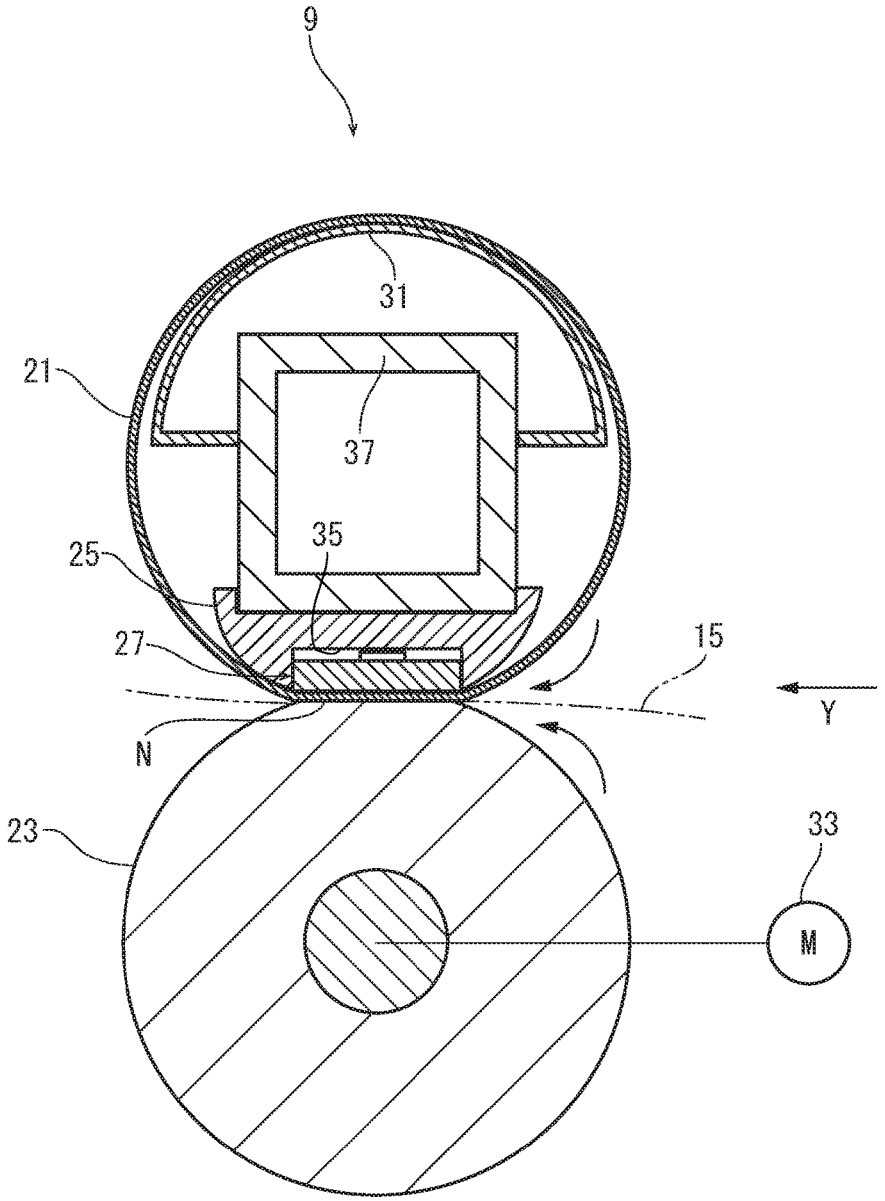
FIG. 2 is a sectional view showing a fixing device according to the embodiment of the present disclosure.

With reference to FIG. 2, the fixing device 9 will be described. FIG. 2 is a sectional view showing the fixing device.

As shown in FIG. 2, the fixing device 9 includes a fixing belt 21 as a fixing member, a pressing roller 23 as a pressing member forming a pressing area N between the fixing belt 21 and the pressing member, a holding member 25 holding the fixing belt 21 to the pressing roller 23 at the pressing area N and a heater 27 supported by the holding member 25 and heating the fixing belt 21.

The fixing belt 21 is an endless belt having a width wider than a width of the maximum size sheet S and a predetermined inner diameter. The fixing belt 21 is made of flexible material, and includes a base layer, an elastic layer provided around an outer circumferential face of the base layer and a release layer provided around an outer circumferential face of the elastic layer. The base layer is made of metal, such as SUS and Ni, for example. The elastic layer is made of silicon rubber, for example. The release layer is made of PFA tube, for example. A sliding layer may be provided around an inner circumferential face of the base layer. The sliding layer is made of polyimidoamide or PTFE, for example.

The fixing belt 21 is supported by a belt guide 31 in a rotatable manner. The belt guide 31 has an arc-shaped cross section along an inner circumferential face of the fixing belt 21, and is made of material having spring property. The belt guide 31 applies tension to the fixing belt 21 to stabilize a rotation track of the fixing belt 21.

The pressing roller 23 includes a core metal, an elastic layer provided around an outer circumferential face of the core metal and a release layer provided around an outer circumferential face of the elastic layer. The elastic layer is made of silicon rubber, for example. The release layer is made of PFA tube, for example.

The pressing roller 23 is arranged below the fixing belt 21, and comes into contact with the fixing belt 21. Between the fixing belt 21 and the pressing roller 23, the pressing area N is formed. The pressing roller 23 is connected to a motor 33, and is driven by the motor 33 to be rotated. When the pressing roller 23 is driven by the motor 33 to be rotated in the counterclockwise direction in FIG. 2, the fixing belt 21 is driven by the pressing roller 23 to be rotated in the clockwise direction opposite to the rotation direction of the pressing roller 23. As a result, the conveyed sheet S passes through the pressing area N along a conveyance direction Y.

The holding member 25 has the substantially same length as a length (a width) in a width direction X (a direction perpendicular to the conveyance direction Y) of the fixing belt 21. The holding member 25 has a lower face curved downward. On the lower face of the holding member 25, a recess 35 is formed along the width direction X.

The holding member 25 is arranged in a hollow space of the fixing belt 21, and is supported by a stay 37. The stay 37 is a rectangular cylindrical shaped member having a length longer than that of the fixing belt 21 in the width direction X. The stay 37 penetrates through the hollow space of the fixing belt 21. The holding member 25 is fixed on a lower face of the stay 37 with the recess 35 facing downward. The above belt guide 31 is fixed on an upper portion of the stay 37.

Figure 3:
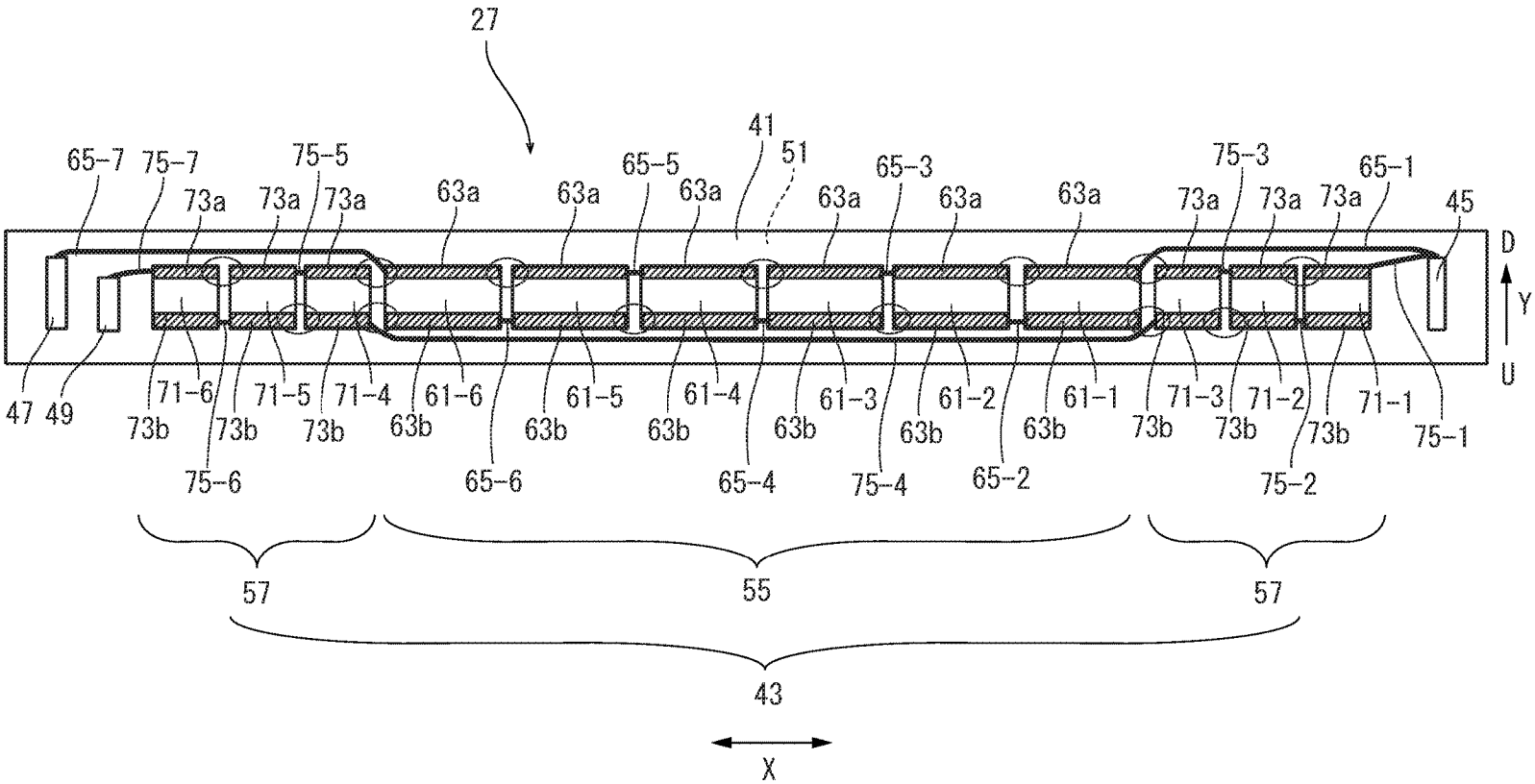
FIG. 3 is a plan view showing a heater according to a first embodiment, in the fixing device according to the embodiment of the present disclosure.

Next, with reference to FIG. 3, the heater 27 according to a first embodiment will be described. FIG. 3 is a plan view showing the heater. The heater 27 includes a ceramic board 41, a heating part 43, a common electrode 45, a first individual electrode 47, a second individual electrode 49 and a glass coating layer 51. The board 41 is a thin plate having the substantially same length as the width of the fixing belt 21. The heating part 43 is provided on one face of the board 41 along the width direction X. The common electrode 45, and the first and second individual electrodes 47 and 49 are provided on outer sides of the heating part 43 in the width direction X. The glass coating later 51 coats a portion other than the common electrode 45, and the first and second individual electrodes 47 and 49.

The heating part 43 has a width corresponding to a width (for example, a length of a shorter side of A3 size sheet (a length of a longer side of A4 size sheet)) of the maximum size sheet (for example, A3 size sheet) and a predetermined length in the conveyance direction Y. The heating part 43 is divided into a center heating part 55 and end heating parts 57 at intervals in the width direction X. The center heating part 55 is arranged on a center side in the width direction X. The end heating parts 57 are arranged on both outer sides of the center heating part 55 in the width direction X. The center heating part 55 has a width corresponding to a width of a narrow size sheet (for example, a postcard, an envelope or A6 size sheet). The heating part 43 is made of carbon, for example, and generates heat by being supplied with electrical power.

The common electrode 45 is arranged on one outer side of the heating part 43 in the width direction X. The first and second individual electrodes 47 and 49 are arranged on the other outer side of the heating part 43 in the width direction X. The first individual electrode 47 is arranged outside the second individual electrode 49. The common electrode 45, and the first and second individual electrodes 47 and 49 are power supplying electrodes supplying the electrical power to the heating part 43.

The glass coating layer 51 coats the one face of the board 41, on which the heating part 43, the common electrode 45 and the first and second individual electrodes 47 and 49 are provided. In some cases, the glass coating layer 51 is not provided.

Next, the center heating part 55 and the end heating parts 57 of the heating part 43 will be described in detail. The center heating part 55 is divided into 2n (n≥2) center heating elements 61 at intervals in the width direction X. The divided center heating elements 61 have a uniform size in the width direction X and the conveyance direction Y, and have a uniform thickness. Each of the end heating part 57 is divided into n end heating elements 71, in other words, the whole end heating parts 57 are divided into 2n end heating elements 71, at intervals in the width direction X. The divided end heating elements 71 have a uniform size in the width direction X and the conveyance direction Y, and have a uniform thickness. The end heating element 71 and the center heating element 61 have the same thickness. In the embodiment, n=3.

First, the center heating part 55 will be described. The center heating part 55 is divided into a first to a sixth center heating elements 61-1 to 61-6 at intervals in the order from a side of the common electrode 45. Each center heating element 61 has electrodes 63 on both end faces in the conveyance direction Y. The electrode on one side D (a downstream side) in the conveyance direction Y is called as one side electrode 63*a*, and the other electrode on the other side U (an upstream side) in the conveyance direction Y is called as the other side electrode 63*b*. The electrode 63 is made of aluminum, for example. The first to the sixth center electrodes 61-1 to 61-6 are connected between the common electrode 45 and the first individual electrode 47 in series.

The common electrode 45 is connected to the one side electrode 63*a* of the first center heating element 61-1 through a first conduction path 65-1. The first conduction path 65-1 is wired outside the end heating part 57 arranged on a side of the common electrode 45. The other side electrode 63*b* of the first center heating element 61-1 is connected to the other side electrode 63*b* of the second center heating element 61-2 through a second conduction path 65-2. The one side electrode 63*a* of the second center heating element 61-2 is connected to the one side electrode 63*a* of the third center heating element 61-3 through a third conduction path 65-3. The other side electrode 63*b* of the third center heating element 61-3 is connected to the other side electrode 63*b* of the fourth center heating element 61-4 through a fourth conduction path 65-4. The one side electrode 63*a* of the fourth center heating element 61-4 is connected to the one side electrode 63*a* of the fifth center heating element 61-5 through a fifth conduction path 65-5. The other side electrode 63*b* of the fifth center heating element 61-5 is connected to the other side electrode 63*b* of the sixth center heating element 61-6 through a sixth conduction path 65-6. The one side electrode 63*a* of the sixth center heating element 61-6 is connected to the first individual electrode 57 through a seventh conduction path 65-7. The seventh conduction path 65-7 is wired outside the end heating part 57 arranged on a side of the first individual electrode 47.

Next, the end heating parts 57 will be described. The end heating parts 57 are divided into a first to a sixth end heating elements 71-1 to 71-6 at intervals in the order from the side of the common electrode 45. Each end heating element 71 has electrodes on both end faces in the conveyance direction Y. The electrode on one side D (the downstream side) in the conveyance direction Y is called as one side electrode 73*a*, and the other electrode on the other side U (the upstream side) in the conveyance direction Y is called as the other side electrode 73*b*. The electrode 73 is made of aluminum, for example. The first to the sixth end heating elements 71-1 to 71-6 are connected between the common electrode 45 and the second individual electrode 49 in series.

The common electrode 45 is connected to the one side electrode 73*a* of the first end heating element 71-1 through a first conduction path 75-1. The other side electrode 73*b* of the first end heating element 71-1 is connected to the other side electrode 73*b* of the second end heating element 71-2 through a second conduction path 75-2. The one side electrode 73*a* of the second end heating element 71-2 is connected to the one side electrode 73*a* of the third end heating element 71-3 through a third conduction path 75-3. The other side electrode 73*b* of the third end heating element 71-3 is connected to the other side electrode 73*b* of the fourth end heating element 71-4 through a fourth conduction path 75-4. The fourth conduction path 75-4 is wired outside the center heating part 55. The one side electrode 73*a* of the fourth end heating element 71-4 is connected to the one side electrode 73*a* of the fifth end heating element 71-5 through a fifth conduction path 75-5. The other side electrode 73*b* of the fifth end heating element 71-5 is connected to the other side electrode 73*b* of the sixth end heating element 71-6 through a sixth conduction path 75-6. The one side electrode 73*a* of the sixth end heating element 75-6 is connected to the second individual electrode 49 through a seventh conduction path 75-7.

By wiring the conduction paths in the above described manner, the conduction paths 65-1 to 65-7 of the center heating part 55 and the conduction paths 75-1 to 75-7 of the end heating parts 57 are wired without crossing each other.

With reference to FIG. 2 again, the heater 27 is stored in the recess 35 of the holding member 25. The heater 27 is stored with the one face, on which the heating part 43 is provided, facing upward (facing a bottom face of the recess 35). Then, the other face of the board 41 comes into contact with the inner circumferential face of the fixing belt 21. Alternatively, the heater 27 may be stored with the face, on which the heating part 43 is provided, facing downward (facing opposing to the bottom face of the recess 35). In this case, the glass coating layer 51 comes into contact with the inner circumferential face of the fixing belt 21.

A fixing operation of the fixing device 9 having the above described configuration will be described. First, the pressing roller 23 is driven by the motor 33 to be rotated, and the fixing belt 21 is driven by the pressing roller 23 to be rotated in the direction opposite to the rotation direction of the pressing roller 23. In a case where the sheet S on which an image is formed has a wide width, a predetermined voltage is applied between the common electrode 45, and the first and second individual electrodes 47 and 49. Thereby, both the center heating part 55 and the end heating parts 57 generate heat to heat the fixing belt 21. The fixing belt 21 is heated to a predetermined temperature (for example, 160° C.). After the fixing belt 21 is heated, the sheet S on which the toner image is transferred is conveyed to the pressing area N. At the pressing area N, the sheet S is conveyed between the fixing belt 21 and the pressing roller 23. At this time, the toner image is heated by the fixing belt 21 heated by the heater 27 and pressed by the fixing belt 21 and the pressing roller 23 to be fixed on the sheet S. The sheet S on which the toner image is fixed is conveyed along the conveyance path 15.

On the other hand, in a case where the sheet S on which an image is formed has a narrow width, such as a postcard or an envelope, a predetermined voltage is applied between the common electrode 45 and the first individual electrode 47. Thereby, the center heating part 55 generates heat to heat the fixing belt 21, whereas the end heating parts 57 generates no heat. As described above, depending on the width of the sheet S, both the center heating part 55 and the end heating parts 57 or only the center heating part 55 generates heat to heat the fixing belt 21 at a portion corresponding to the width of the sheet S.

Figure 7:
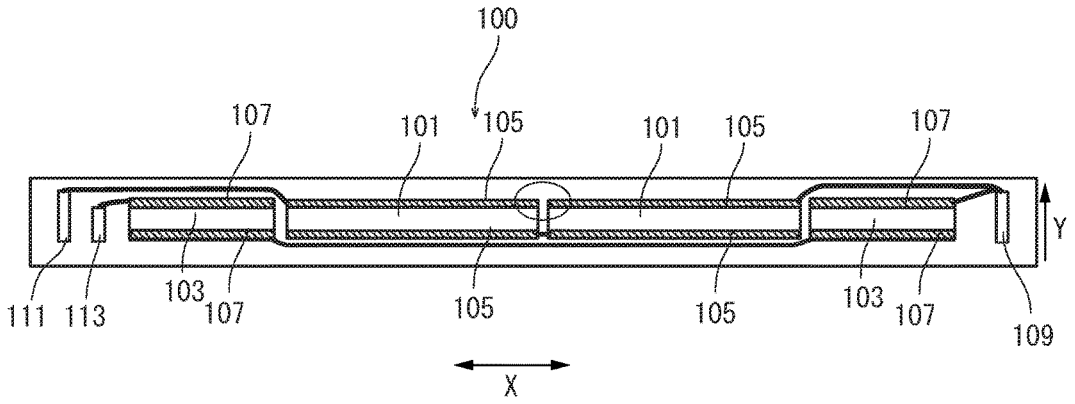
FIG. 7 is a plan view showing another conventional heater.

By the way, because the six center heating elements 61-1 to 61-6 and the six end heating elements 71-1 to 71-6 are connected between the common electrode 45, and the first and second individual electrode 47 and 49, respectively, in series, each heating element is applied with ⅙ of the voltage (an applied voltage V) applied between the common electrode 45, and each of the first and second individual electrodes 47 and 49. Then, between the electrodes of the adjacently arranged heating elements (between the electrodes not connected to the conduction paths, portions surrounded by circles in FIG. 3), ⅓ (⅙+⅙) of the applied voltage V is applied. On the other hand, in the conventional embodiment shown in FIG. 7, between the electrodes of the adjacently arranged heating elements, the applied voltage V is applied. Accordingly, the present embodiment makes it possible to decrease the voltage applied between the electrodes of the adjacently arranged heating elements to ⅓ of that of the conventional embodiment. As a result, it becomes possible to make a distance between the electrodes of the adjacently arranged heating elements shorter than that of the conventional embodiment.

As described above, according to the fixing device 9 of the present disclosure, because the center heating part 55 and the end heating parts 57 are divided into the heating elements 61 and 71 respectively, it becomes possible to shorten a distance between the electrodes of the adjacently arranged heating elements. Accordingly, it becomes possible to make the temperature distribution in the width direction X uniform. Additionally, because it becomes possible to wire the conduction paths 65 connecting the center heating elements 61 and the conduction paths 75 connecting the end heating elements 75 without crossing each other, a short circuit hardly occurs between the conduction paths 65 and 75.

The first to the sixth center heating elements 61-1 to 61-6 have a uniform size in the width direction X and in the conveyance direction Y, and have a uniform thickness. The first to the sixth end heating elements 71-1 to 71-6 have a uniform size in the width direction X and in the conveyance direction Y, and have a uniform thickness. The thickness of the center heating element 61 is the same as the thickness of the end heating element 71. Additionally, the center heating part 55 and the end heating parts 57 are divided into the same number of the center heating elements 61 and the end heating elements 7, respectively. Accordingly, a voltage applied to each heating element becomes uniform. As a result, a resistance per unit area of each heating element becomes uniform so that it becomes possible to make the temperature distribution uniform.

Figure 4:
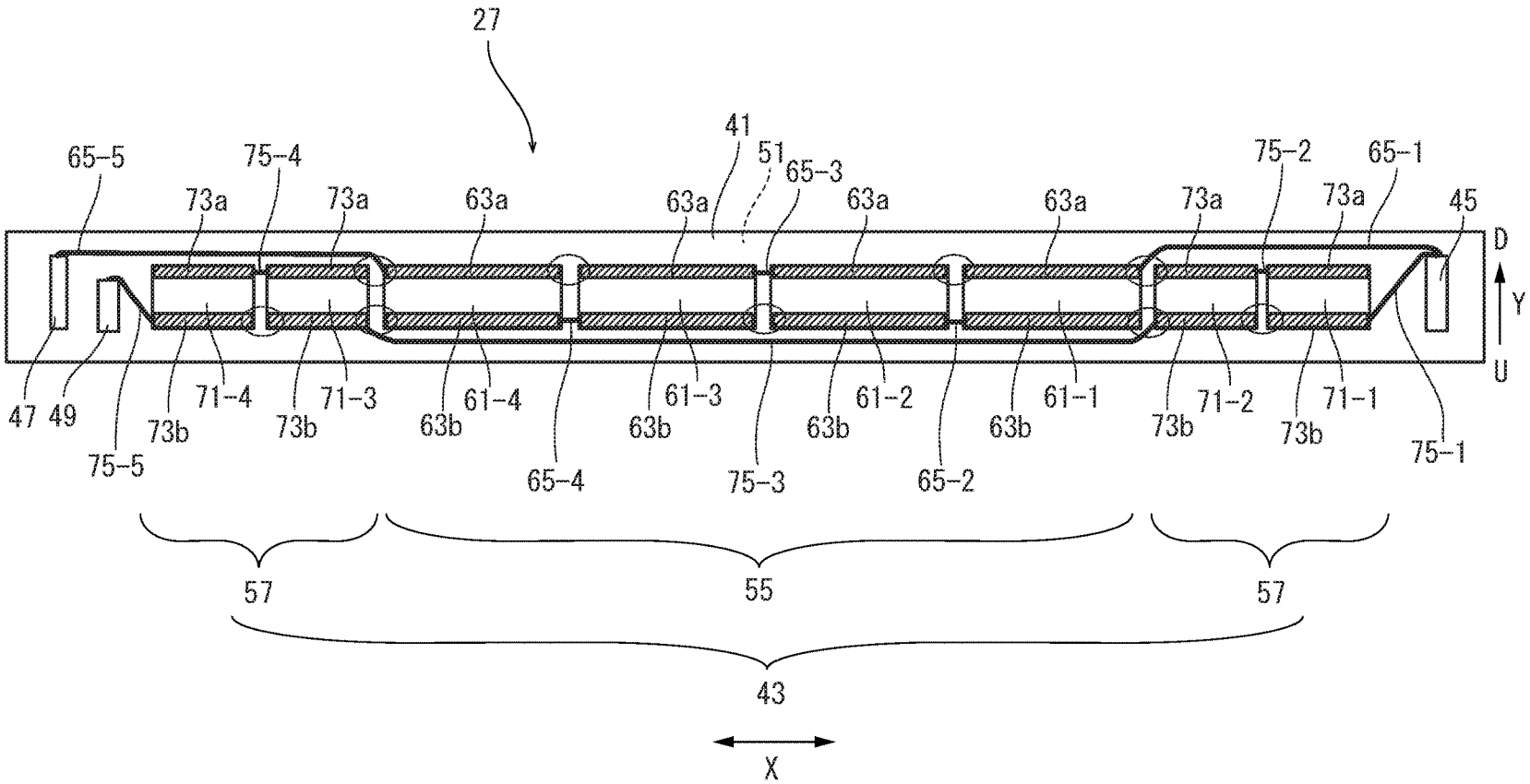
FIG. 4 is a plan view showing the heater according to a second embodiment, in the fixing device according to the embodiment of the present disclosure.

Next, with reference to FIG. 4, the heater 27 according to a second embodiment will be described. FIG. 4 is a plan view showing the heater. The second embodiment shows a case of n=2.

First, the center heating part 55 will be described. The center heating part 55 is divided into the first to the fourth center heating elements 61-1 to 61-4 at intervals in the order from the side of the common electrode 45.

The common electrode 45 is connected to the one side electrode 63*a* of the first center heating element 61-1 through a first conduction path 65-1. The first conduction path 65-1 is wired outside the end heating part 57 arranged on the side of the common electrode 45. The other side electrode 63*b* of the first center heating element 61-1 is connected to the other side electrode 63*b* of the second center heating element 61-2 through a second conduction path 65-2. The one side electrode 63*a* of the second center heating element 61-2 is connected to the one side electrode 63*a* of the third center heating element 61-3 through a third conduction path 65-3. The other side electrode 63*b* of the third center heating element 61-3 is connected to the other side electrode 63*b* of the fourth center heating element 61-4 through a fourth conduction path 65-4. The one side electrode 63*a* of the fourth center heating element 61-4 is connected to the first individual electrode 47 through a fifth conduction path 65-5. The fifth conduction path 65-5 is wired outside the end heating part 57 arranged on the side of the first individual electrode 47.

Next, the end heating parts 57 will be described. The end heating parts 57 are divided into the first to fourth end heating elements 71-1 to 71-4 at intervals in the order from the side of the common electrode 45.

The common electrode 45 is connected to the other side electrode 73*b* of the first end heating element 71-1 through a first conduction path 75-1. The one side electrode 73*a* of the first end heating element 71-1 is connected to the one side electrode 73*a* of the second end heating element 71-2 through a second conduction path 75-2. The other side electrode 73*b* of the second end heating element 71-2 is connected to the other side electrode 73*b* of the third end heating element 71-3 through a third conduction path 75-3. The third conduction path 75-3 is wired outside the center heating part 55. The one side electrode 73*a* of the third end heating element 71-3 is connected to the one side electrode 73*a* of the fourth end heating element 71-4 through a fourth conduction path 75-4. The other side electrode 73*b* of the fourth end heating element 71-4 is connected to the second individual electrode 49 through a fifth conduction path 75-5.

In the second embodiment, because the four center heating elements 61-1 to 61-4 and the four end heating elements 71-1 to 71-4 are connected between the common electrode 45, and the first and second individual electrode 47 and 49, respectively, in series, each heating element is applied with ¼ of the applied voltage V. Then, between the electrodes of the adjacently arranged heating elements (between the electrodes not connected to the conduction paths, portions surrounded by circles in FIG. 4), ½ of the applied voltage V is applied. As described above, the second embodiment makes it possible to decrease the voltage applied between the electrodes of the adjacently arranged heating elements, compared with the conventional embodiment shown in FIG. 7, and it becomes possible to make a distance between the electrodes of the adjacently arranged heating elements shorter than that of the conventional embodiment.

As the first and second embodiments, by dividing the center heating part 55 and the end heating parts 57, it becomes possible to make the voltage applied between the electrodes of the adjacently arranged heating elements small and to make the distance between the adjacently arranged heating elements short. As the division number (the number of n) is large, the voltage applied between the electrodes of the adjacently arranged heating elements becomes small.

However, in a case of n=4, the voltage applied between the electrodes of some of the adjacently arranged heating elements becomes larger than that in the case of n=3.

Figure 5:
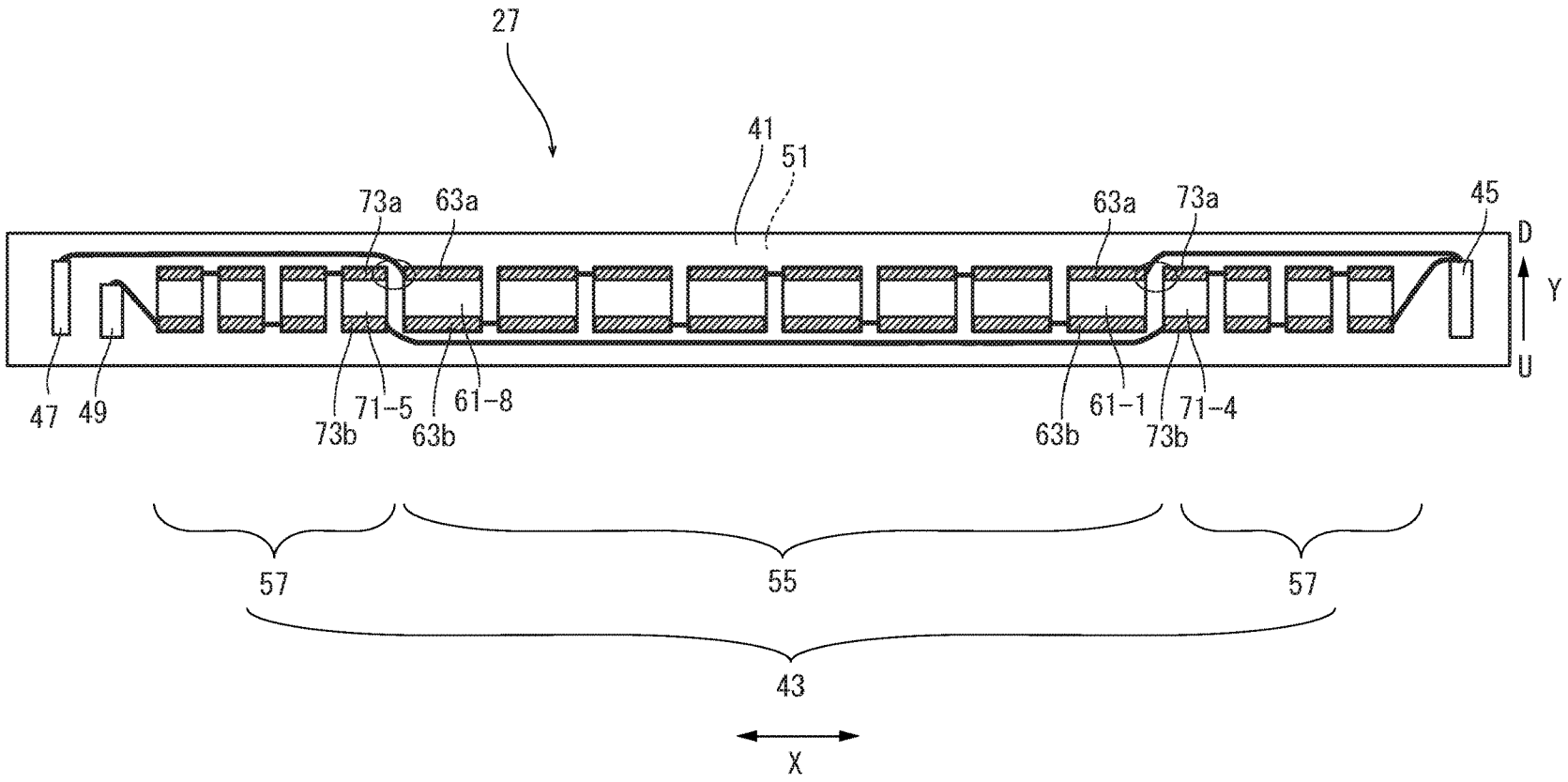
FIG. 5 is a plan view showing the heater according to a third embodiment, in the fixing device according to the embodiment of the present disclosure.
Figure 6:
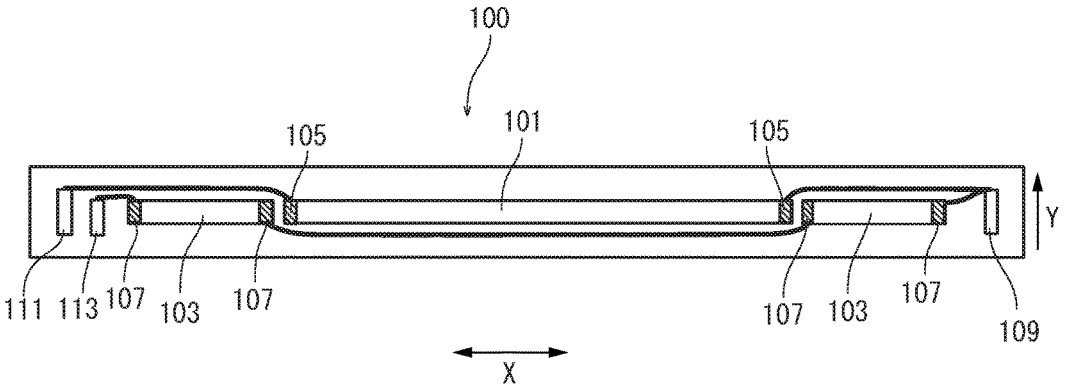
FIG. 6 is a plan view showing a conventional heater.

With reference to FIG. 5, a case of n=4 (a third embodiment) will be described. FIG. 5 is a plan view showing the heater. The one side electrode 73*a* of the fourth end hating elements 71-4 arranged adjacent to the first center heating element 61-1 is applied with a voltage of $3\times(1/8)=3/8$ of the applied voltage V. On the other hand, in a case of n=3, as described above, the one side electrode 73*a* of the third end heating element 71-3 arranged adjacent to the first center heating element 61-1 is applied with $2\times(1/6)=1/3$ of the applied voltage V. Because of $3/8>1/3$, in a case of n=4, it is required to make a distance between the adjacently arranged end heating element 71 and center heating element 61 (a distance between the fourth end heating element 71-4 and the first center heating element 61-1, a distance between the eighth center heating element 61-8 and the fifth end heating element 71-5, portions surrounded by circles in FIG. 5) longer than that in a case of n=3. However, in a case of n=4, it becomes possible to make the voltage applied between the electrodes of the adjacently arranged heating elements smaller than that of the conventional embodiment shown in FIG. 7 and to make the distance between the adjacently arranged heating elements smaller than that of the conventional embodiment.

The above results show that a case of n=3 is preferable because the distance between the adjacently arranged heating elements is made to be smallest.

To compare the first embodiment (refer to FIG. 3) with the second embodiment (refer to FIG. 4), in the first embodiment, the common electrode 45 is connected to the one side electrode 63*a* of the first center heating element 61-1 and the one side electrode 73*a* of the first end heating element 71-1. On the other hand, in the second embodiment, the common electrode 45 is connected to the one side electrode 63*a* of the first center heating element 61-1 and the other side electrode 73*b* of the first end heating element 71-1. That is, in a case where n is an odd number, the common electrode 45 is connected to the electrodes at the same side of the first center heating element 61-1 and the first end heating element 71-1, whereas, in a case where n is an even number, the common electrode 45 is connected to the electrodes at the different sides of the first center heating element 61-1 and the first end heating element 71-1.

The above connection makes it possible to wire the conduction paths 65 connecting the center heating elements in series and the conduction paths 75 connecting the end heating elements in series without crossing each other.

While the above description has been described with reference to the particular illustrative embodiments, the present disclosure is not limited to the above embodiments. It is to be appreciated that those skilled in the art can change or modify the embodiments without departing from the scope and spirit of the present disclosure.

The invention claimed is:

1. A fixing device comprising:

a fixing member and a pressing member configured to form a pressing area; and a heater configured to heat a toner on a sheet conveyed to the pressing area, wherein the heater includes:

a center heating part arranged on a center side in a width direction perpendicular to a sheet conveyance direction;

end heating parts arranged on both outer sides of the center heating part in the width direction;

a common electrode arranged on one outer side of the end heating parts in the width direction; and a first individual electrode and a second individual electrode which are arranged on the other outer side of the end heating parts in the width direction, wherein the center heating part is divided into 2n (n≥2) center heating elements at intervals in the width direction, the center heating elements each having electrodes on both end faces in the conveyance direction and connected between the common electrode and the first individual electrode in series, and each of the end heating parts is divided into n end heating elements at intervals in the width direction, the end heating elements each having electrodes on both end faces in the conveyance direction and connected between the common electrode and the second individual electrode in series.

2. The fixing device according to claim 1, wherein n=3.

3. The fixing device according to claim 1, wherein the center heating elements have a uniform size in the width direction, and the end heating elements have a uniform size in the width direction.

4. The fixing device according to claim 1, wherein the center heating elements have a uniform size in the conveyance direction, and the end heating elements have a uniform size in the conveyance direction.

5. The fixing device according to claim 1, wherein the center heating element and the end heating element have a uniform thickness.

6. The fixing device according to claim 1, wherein in a case where n is an odd number, the common electrode is connected to the electrodes of the center heating element and the end heating element on the same side in the conveyance direction, and in a case where n is an even number, the common electrode is connected to the electrodes of the center heating element and the end heating element on different sides in the conveyance direction.

7. The fixing device according to claim 1, wherein conduction paths connecting the center heating elements in series and conduction paths connecting the end heating elements in series are wired without crossing each other.

8. An image forming apparatus comprising:

an image forming part configured to form a toner image on a sheet; and the fixing device according to claim 1, configured to fix the toner image on the sheet.

* * * * *